6/11/86 CR 4,593,818

United States Patent [19]

Schenkman

[11] Patent Number: 4,593,818

[45] Date of Patent: Jun. 10, 1986

[54] CAN STACKER

[76] Inventor: Roger B. Schenkman, 458 Sycamore Rd., Santa Monica, Calif. 90402

[21] Appl. No.: 728,473

[22] Filed: Apr. 29, 1985

[51] Int. Cl.[4] ..... B65D 21/02

[52] U.S. Cl. ..... 206/503; 206/821

[58] Field of Search ..... 206/503, 821

[56] References Cited

U.S. PATENT DOCUMENTS

| | | | |
|---|---|---|---|
| D. 258,351 | 2/1981 | Firanzi . | |
| D. 258,869 | 4/1981 | Firanzi . | |
| 1,757,192 | 5/1930 | Hothersall | 206/503 |
| 1,984,570 | 12/1934 | Emmons | 206/821 |
| 2,100,035 | 11/1937 | Merrick | 206/821 |
| 2,249,764 | 7/1941 | Hothersall | 206/821 |
| 2,292,310 | 8/1942 | Wilkins | 206/821 |
| 2,661,097 | 12/1953 | Paul | 206/821 |
| 2,918,165 | 12/1959 | Paulick | 206/503 |
| 2,957,601 | 10/1960 | Novick | 206/821 |
| 3,237,802 | 3/1966 | Wagner . | |
| 3,317,087 | 5/1967 | Landis | 206/821 |

*Primary Examiner*—George E. Lowrance

*Attorney, Agent, or Firm*—Henry M. Bissell

[57] ABSTRACT

The can stacker is in the form of a flexible resilient split ring of elastic memory-retaining material such as rubber or plastic, capable of being opened to accommodate the rims of cans of various diameters. The ring includes a generally vertical, annular split rim and a number of separate, spaced, generally horizontal fins adapted collectively to support a can. The fins extend radially inwardly from the rim on opposite sides of the split and are connected to the inner margin of the rim at about the vertical mid point thereof by preferably narrow stems bearing annular recesses on their upper and lower surfaces. The recesses and the rim inner surfaces form can rim-receiving grooves. The fins may be tapered inwardly to facilitate closing the rim to accommodate smaller diameter cans. The can stacker is adapted to loosely receive the rims of a pair of cans to be vertically stacked. When in place, the can stacker maintains the vertical alignment of the two cans and physically supports the upper one of the two cans. The can stacker is simple, durable, inexpensive and effective in use.

15 Claims, 6 Drawing Figures

CAN STACKER

BACKGROUND OF THE INVENTION

1. Field of the Invention

The present invention generally relates to stacking means for goods and, more particularly, to an improved type of can stacker.

2. Description of the Prior Art

Various types of constructions have been provided in the past to assist in the alignment and stacking of cans on shelves and the like. See, for example, U.S. Pat. No. 2,957,601 which discloses a closed ring with raised rim adapted to fit the rim of a can. U.S. Pat. No. 3,237,802 discloses a similar closed ring. So also do U.S. Pat. Nos. 3,317,087 and 2,661,097. In addition, U.S. Pat. No. 2,661,097 and U.S. Design Pat. Nos. 258,351 and 258,869 disclose can stackers which are star shaped instead of being ring-like in configuration.

All the described ring-shaped devices are subject to the same deficiency in that when they are designed to grip the rim of a can, they can only be used with cans of a single diameter. Devices of different sizes must therefore be manufactured, stacked and sold to accommodate the stacking of cans of various diameters. This is a considerable expense. Those can stackers of single size which can be used with various diameters of cans are rigid and not ring-shaped. Moreover, they do not grip a substantial area of the can rims and thus they are difficult to install but easy to dislodge from the cans. Moreover, they do not exert sufficient control of vertical alignment of the can stack.

Accordingly, there is a need for an improved type of can stacker which will accommodate cans of various diameters, hold them firmly supported in vertically stacked array, and which will be easily and quickly installed and removed from the cans. Moreover, such a can stacker should permit the easy removal of cans from the stack without affecting the remainder of the can stack. The can stacker should be inexpensive, durable, simple and effective.

SUMMARY OF THE INVENTION

The improved can stacker of the present invention satisfies all the foregoing needs. The can stacker is substantially as set forth in the Abstract. Thus, it is a simple unitary structure, readily durable and inexpensively molded of flexible, resilient, elastic memory-retaining material such as natural or synthetic rubber or plastic or a mixture thereof. It is in the form of a split ring openable to various widths (diameters) to accommodate cans of a wide variety of diameters.

The ring includes a vertical outer split rim, to the inner surface of which are connected a plurality of spaced, horizontal, radially inwardly directed fins disposed on opposite sides of the rim slit and adapted to support a can. Preferably, the fins are wedge-shaped. They have annular recesses at the top and bottom of their outer periphery to define, with the rim, upper and lower can rim-receiving grooves. Integral narrow stems bearing the annular recesses may connect the fins with the rim.

The grooves are dimensioned to loosely fit the usual types of can rims to allow the ring to be easily put in place and cans to be easily removed therefrom. When a can is very large in diameter, a pair or more of the rings can be provided, spaced along the can rim to properly support the can. The can need not even be perfectly cylindrical. Thus, the ring is capable of being fitted to slightly oval or irregularly shaped cans. The can stacker flexes and can follow the irregular curvature of the can rim.

BRIEF DESCRIPTION OF THE DRAWINGS

A better understanding of the present invention may be had from a consideration of the following detailed description, taken in conjunction with the accompanying drawings in which.

DESCRIPTION OF THE PREFERRED EMBODIMENTS

FIGS. 1-3

Figure 1:
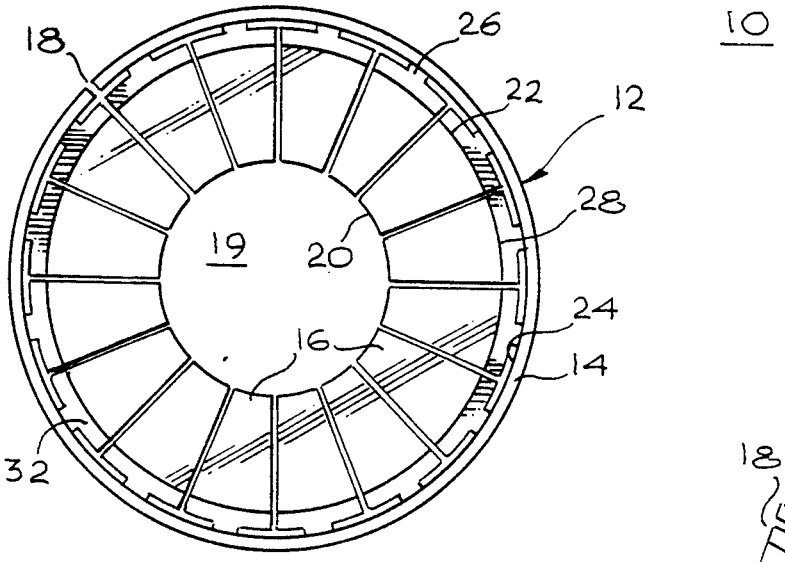
FIG. 1 is a schematic top plan view of a first preferred embodiment of the improved can stacker of the present invention, shown in the relaxed, nearly closed state.
Figure 2:
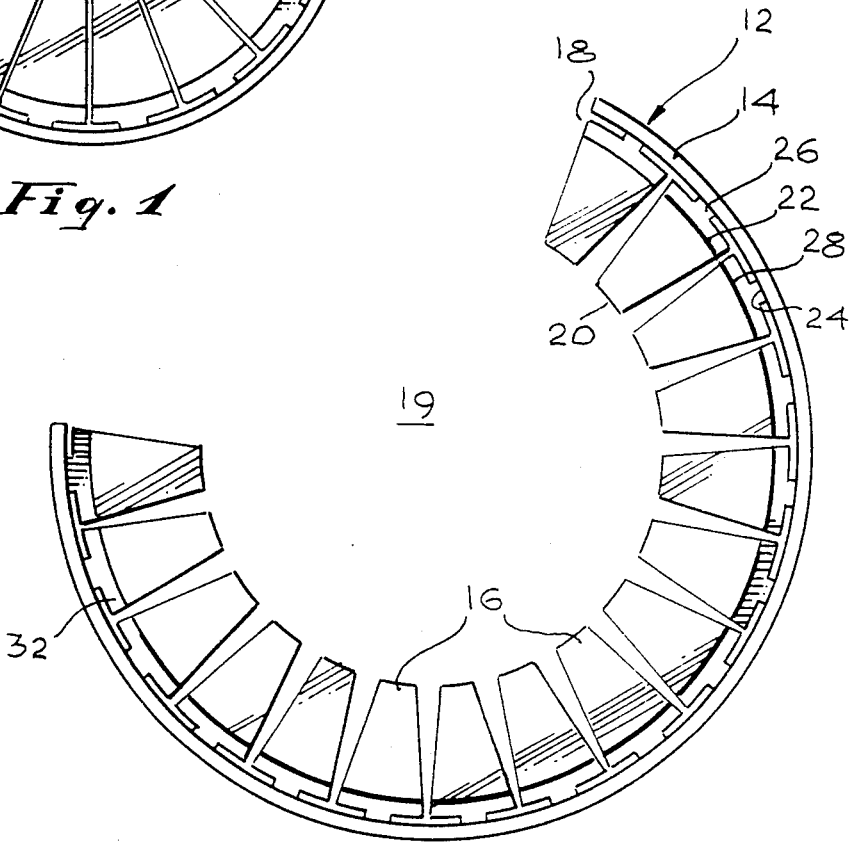
FIG. 2 is a schematic top plan view of the improved can stacker of FIG. 1, shown in the flexed open state.
Figure 3:
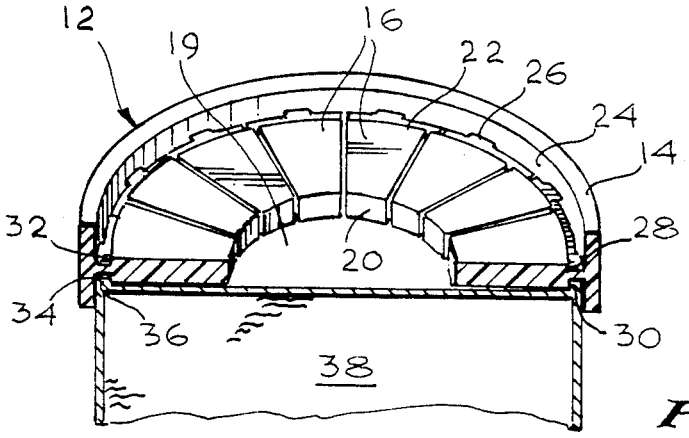
FIG. 3 is a schematic fragmentary perspective view, partly broken away and partly in section, of the improved can stacker of FIG. 1, shown applied over the top of a can.

Now referring more particularly to FIGS. 1-3 of the accompanying drawings, a first preferred embodiment of the improved can stacker of the present invention is schematically depicted therein. Thus, can stacker 10 is shown which comprises a split ring 12 of flexible resilient material such as moldable, elastic, memory-retaining natural rubber, synthetic rubber, plastic or a mixture thereof. Ring 12 comprises a number of integral components, including a generally annular split rim 14 at the outer periphery thereof integrally connected to a generally horizontal plurality (in this instance 16) of separate spaced fins 16 extending radially inwardly therefrom about the rim.

Each of fins 26 is generally wedge-shaped with a smaller inner periphery 20, and a larger outer periphery 22 adjacent rim 14. The peripheries 20 collectively define central opening 19 in ring 12. Each fin 16 is connected to the inner margin 24 of rim 14, preferably at about the mid point of the vertical height of rim 14, by an annular narrow width band or stem 26 which is integral with fin 16 and which improves the flexibility and openability of ring 12.

The outer periphery 22 of each fin 16 and each stem 26 bears a recess 28 on the top thereof and a matching recess 30 on the bottom thereof, recesses 28 and 30 being of about equal depth and forming with rim 14 annular grooves 32 and 34 of about equal depth. The rims of two cans, such as the rim 36 of can 38 below fins 16 (FIG. 3) and the rim of a second can (not shown) above fins 16, are adapted to loosely seat (FIG. 3) in grooves 32 and 34 in order to have stacker 10 support and maintain the two cans in vertical stacked alignment. Grooves 32 and 34 are dimensioned to permit can stacker 10 to easily accept the two cans therein and to permit easy separation of one or both such cans from stacker 10.

Should a can be of a diameter substantially larger than the diameter of ring 12 in the relaxed state (FIG. 1), ring 12 can be flexed open (FIG. 2) to accommodate the larger can diameter and still perform its can supporting and vertical alignment functions. The ring 12 can even be opened to assume an arc of 180° or less such that two or more can stackers 10 would be placed between a pair of very large diameter cans with the ring 14, fins 16 and stems 26 maintaining the support and alignment of the stacked cans. It will be understood that can stacker 10 can also be made and used in various diameters and that a plurality of can stackers 10 can be employed in the vertical stacking of more than two cans. Stackers 10 will be disposed between adjacent ones of the cans in the vertical stacking so that rims 14 maintain their vertical alignment and so that fins 16 help support the can, for example, on a grocery shelf or the like. In a typical embodiment, ring 12 may be about 2.75 inches O.D. with a height of rim 14 of about 0.5 inch, thickness of fins 16 of about 5/16 inch and width of grooves 32 and 24 of about 1/16 inch, although other dimensions can be used.

FIG. 4

Figure 4:
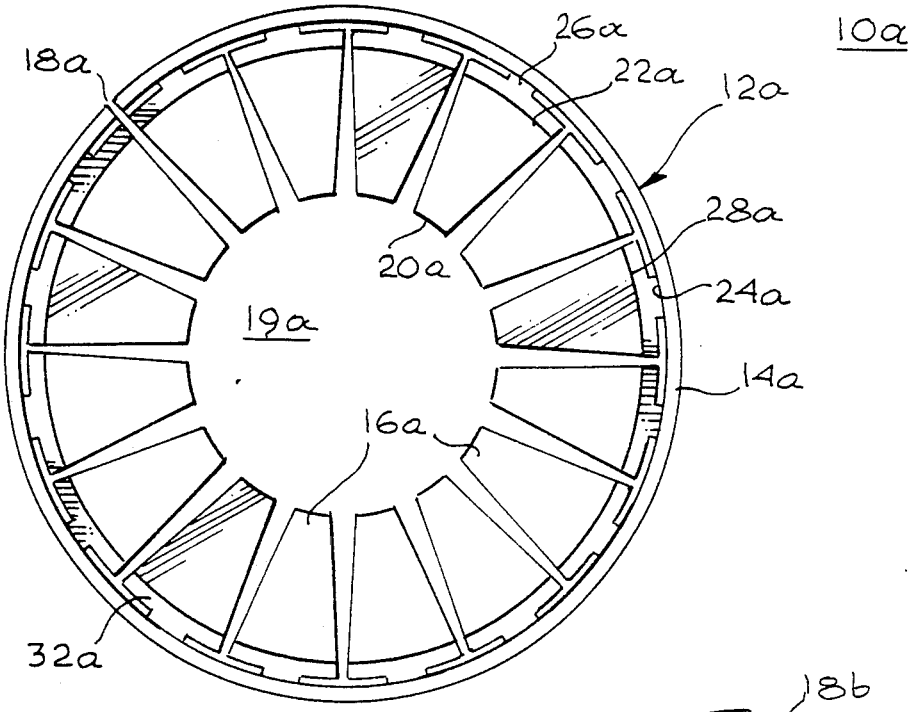
FIG. 4 is a schematic top plan view of a second preferred embodiment of the improved can stacker of the present invention, shown in the relaxed, nearly closed state.

A second preferred embodiment of the improved can stacker of the present invention is schematically depicted in FIG. 4. Thus, can stacker **10*a* is shown. Components thereof similar to those of can stacker 10 bear the same numerals but are succeeded by the letter "a". Can stacker 10*a* differs from can stacker 10 only in that wedge-shaped fins 16*a* have relatively narrower inner peripheries 20*a* than those of fins 16. This facilitates reducing the diameter of ring 12*a* when one or more fins 16*a* are snipped off, together with a corresponding portion of the ring 12*a*, in order to make stacker 10*a* fit a very small diameter can (smaller than the diameter of the stacker, as manufactured). Ring 12*a* also contains rim 14*a*, rim split 18*a*, central opening 19*a*, stems 26, recess 28*a* and a recesss (not shown) identical to recess 30, groove 32*a* and a groove (not shown) identical to groove 34 on the opposite side. Can stacker 10*a* is very similar in function and properties to can stacker 10**.

FIGS. 5–6

Figure 5:
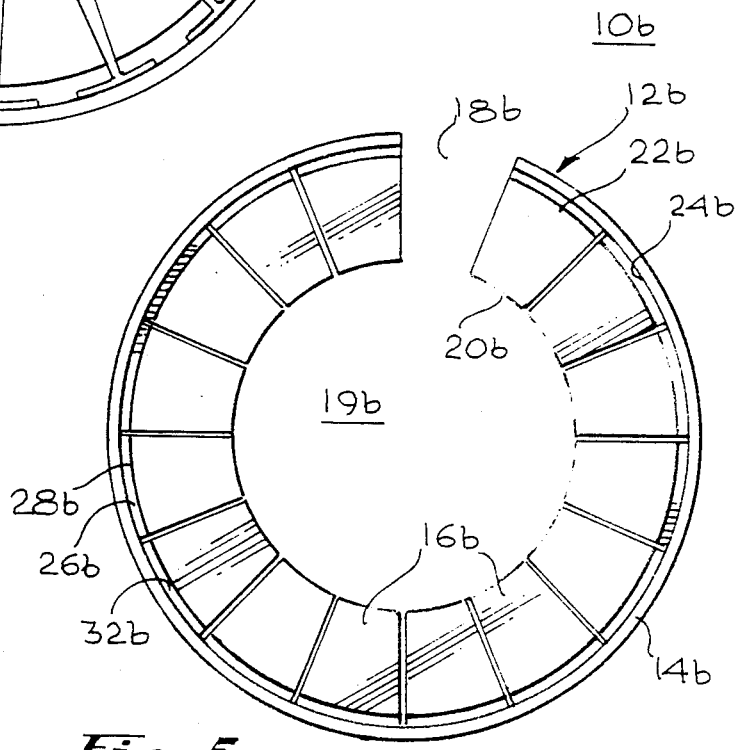
FIG. 5 is a schematic top plan view of a third preferred embodiment of the improved can stacker of the present invention, shown in the relaxed state.
Figure 6:
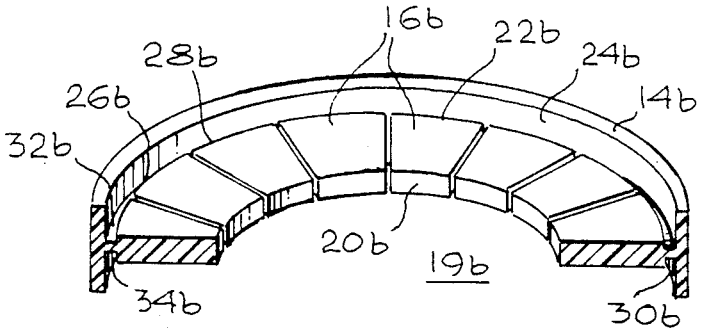
FIG. 6 is a schematic fragmentary perspective view, partly in section, of the improved can stacker of FIG. 5.

A third preferred embodiment of the improved can stacker of the present invention is schematically depicted in FIGS. 5 and 6. Thus, stacker **10*b* is shown which is very similar to stackers 10 and 10*a*. Components thereof corresponding to those of stacker 10 and/or stacker 10*a*** bear the same numerals but are succeeded by the letter "b".

There are only two basic differences between stacker **10*b* and stackers 10 and 10*a*. Fins 16*b* are closer to rectangular than wedge-shaped so that their inner peripheries 20*b* are relatively wider than peripheries 20 and 20*a*, i.e., peripheries 20*b* are closer in width to outer peripheries 22*b*. Also, the stems 26*b* are a full width extension of fins 16*b***, *l instead of being of substantially narrower width. Rim 14b*, opening **19*b*, recesses 28*b* and 30*b*, grooves 32*b* and 34*b* of can stacker 10*b* are similar to those components of can stackers 10 and 10*a*. Moreover, can stacker 10*b* functions essentially similarly and has similar properties to can stackers 10 and 10*a***, except for somewhat reduced flexibility.

Although there have been described above specific arrangements of an improved can stacker in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. An improved can stacker, said can stacker comprising a unitary structure in the form of an openable, split, flexible, resilient ring, said ring including:

(a) a finned annular split rim;

(b) a plurality of separate, spaced, generally horizontal fin portions integrally formed as parts of said rim and adapted to support a can and extending radially inwardly from said rim on opposite sides of said split, said fin portions being connected to the inner margin of said rim and having annular recesses at the top and bottom of the outer periphery thereof to form with said rim upper and lower can rim-receiving grooves;

said stacker being openable to engage the rims of a pair of cans to be vertically stacked, so as to establish and maintain the vertical alignment of said cans and to physically support the upper one of said pair of cans on the fin portions resting on the lower one of said cans.

2. The device of claim 1 wherein said ring when in the unflexed state is at least nearly closed and wherein said ring when in the open extended state is C-shaped.

3. The device of claim 1 wherein each of said fin portions is connected to said inner margin of said rim at about the mid point of the vertical height thereof, and wherein said annular recesses are of about equal depth so that said grooves are about of equal depth.

4. The device of claim 1 wherein each of said fin portions is connected to said inner margin of said rim by an integral stem of less width than the remainder of said fin portion in order to improve the flexibility and

5. The device of claim 4 wherein the width of each stem is a small fraction of the width of an associated fin portion to permit opening of the ring to an arc of less than 180° for accommodating large diameter cans.

6. The device of claim 1 wherein each of said fin portions is tapered and has a narrower width at its inner periphery than at its outer periphery in order to permit deformation of said ring to a reduced diameter for engaging the rims of cans of a corresponding diameter.

7. The device of claim 6 wherein said rim is readily severable in the region between adjacent fin portions to permit the removal of a selected fin portion and rim segment in order to facilitate said deformation to reduced diameter.

8. The device of claim 1 wherein the fin portions and the rim are configured such that the stacker is deformable to assume a reduced diameter for engaging the rims of cans of lesser diameter than that of the stacker in the unflexed state.

9. The device of claim 1 wherein said fin portions are generally wedge-shaped, with the broadest portion thereof near said rim and wherein said fins are connected to said inner surface of said rim by integral narrow stems bearing said recesses.

10. The device of claim 3 wherein said stacker comprises molded memory-retaining material selected from the group consisting of natural rubber, synthetic rubber, plastic and mixtures thereof.

11. An improved can stacker comprising:

a split annular support member formed of a flexible resilient material; and a plurality of fin elements, all being generally coplanar and aligned to point radially inward about a common central axis, each of said elements being joined along at least a portion of the outer periphery thereof to the inner surface of the annular support member, the fin elements being shaped to define upper and lower recesses adjacent the outer periphery thereof which form, with said annular support member, upper and lower can rim-receiving grooves;

said stacker being variable in curvature to adjust to the size of cans to be vertically stacked, the stacker when so adjusted and placed between a pair of like diameter cans serving to maintain the vertical alignment thereof and to physically support the upper one of said cans on fin element portions extending between the cans.

12. The device of claim 11 wherein the split in the annular member is generally aligned with the terminal edges of the end fin elements.

13. The device of claim 12 wherein the juncture portion along the peipheral edge of each fin element forms a stem which is generally centrally located relative to the extent of the peripheral edge of the associated fin element, there being spaces on either side of the stem between the annular member and the fin element to permit expansion of the annular member without distorting the fin elements.

14. The device of claim 13 wherein the stems and the fin elements are disposed such that the radially inner ends of the fin elements separate generally equally from each other as the annular member is opened up for accommodating large size cans.

15. The device of claim 11 wherein the fin elements are shaped such that their adjacent edges diverge from each other when the annular member is closed with its ends adjacent one another in order to permit adjustment of the annular member to a smaller diameter upon removing one or more of the fin elements and an associated portion of the annular member.

* * * * *